US007178536B2

(12) United States Patent
Holtkamp

(10) Patent No.: US 7,178,536 B2
(45) Date of Patent: Feb. 20, 2007

(54) AWNING CONSTRUCTION AND CAMPING ACCOMMODATION PROVIDED WITH AN AWNING CONSTRUCTION

(76) Inventor: Egbert Berend Holtkamp, Hoofdkade 92a, Ter Apel, 9561 JK (NL)

( * ) Notice: Subject to any disclaimer, the term of this patent is extended or adjusted under 35 U.S.C. 154(b) by 236 days.

(21) Appl. No.: 10/617,249

(22) Filed: Jul. 11, 2003

(65) Prior Publication Data

US 2004/0069416 A1 Apr. 15, 2004

(30) Foreign Application Priority Data

Jul. 12, 2002 (NL) ..... 1021062

(51) Int. Cl.
*E04H 15/06* (2006.01)
*E04F 10/06* (2006.01)

(52) U.S. Cl. ..... 135/88.13; 135/88.12; 296/163; 160/66

(58) Field of Classification Search ..... 135/88.1, 135/88.11, 88.12, 88.13, 88.14, 88.15; 296/98, 296/159, 163, 180.4; 160/66–68, 70–71, 160/76–77

See application file for complete search history.

(56) References Cited

U.S. PATENT DOCUMENTS 2,107,608 A * 2/1938 Hewlett ..... 135/90
2,808,065 A * 10/1957 Ellis ..... 135/123
3,612,145 A * 10/1971 Darula et al. ..... 160/67
4,117,876 A * 10/1978 Bennett ..... 160/67
4,848,386 A * 7/1989 Cooper ..... 135/90
5,170,811 A * 12/1992 Kirk et al. ..... 135/88.11
5,718,253 A * 2/1998 McNamee ..... 135/88.13
6,131,990 A * 10/2000 Crean ..... 296/163
6,273,172 B1 * 8/2001 Frey ..... 160/67

FOREIGN PATENT DOCUMENTS

| | | | |
|---|---|---|---|
| AU | 609426 | B | 5/1991 |
| DE | 1580419 | A | 12/1970 |
| DE | 7230788 | U | 12/1972 |
| DE | 19739254 | C | 7/1999 |
| EP | 0415233 | A | 3/1991 |
| EP | 0454933 | B1 | 6/1991 |
| GB | 2349365 | A | 11/2000 |
| NL | 8006627 | A | 7/1982 |

* cited by examiner

*Primary Examiner*—Winnie Yip
(74) *Attorney, Agent, or Firm*—Jacobson Holman PLLC

(57) ABSTRACT

An awning construction for a camping accommodation or the like, including a roof and at least one side wall, as well as a container which is mountable on a wall of a camping accommodation, which is arranged to include, in a closed position of the rest, at least the tent cloth of an awning, wherein the container includes, in mounted condition, a substantially horizontal and at least one substantially vertical section, which container further has an open position to take the awning out of the container and put it up and wherein the container is further provided with a fixing device for an edge of the tent cloth of the awning, located, in the operative position, in the container.

29 Claims, 11 Drawing Sheets

AWNING CONSTRUCTION AND CAMPING ACCOMMODATION PROVIDED WITH AN AWNING CONSTRUCTION

FIELD OF THE INVENTION

The invention relates to an awning construction for a camping accommodation and the like, comprising a roof and at least one side wall as well as to a camping accommodation and the like provided with an awning construction.

BACKGROUND OF THE INVENTION

Awnings are generally known and are used to enlarge the living space of a camping accommodation, mostly a mobile camping accommodation, such as, for instance, a caravan, a camper (or motor home) and the like. Such an awning usually comprises, in addition to a roof, at least one side wall. Also, typically, a front wall is present and/or a canopy fixed to the awning, which extends beyond the side wall(s). Such awnings are often detachably fixed to a wall of the camping accommodation or the like by means of a so-called caravan rail. A caravan rail usually comprises a metal or possibly plastic profile, in which an edge of a tent cloth provided with a beading can be slid. A beading is a thickening sewn into a hem, for instance consisting of a cord, cable or the like, or an elongated bendable element of, for instance, metal or plastic.

A drawback of the known awnings is that they are difficult to fit. Sliding the beading into the caravan rail or the like is often laborious in that dirt and/or oxidation of the profile render(s) sliding more difficult. Also, the beading often slides extra heavily in the bent parts of the rail, because a bend in principle forms an extra resistance, which is often increased in that in the bend, the diameter of the opening in the rails exhibits deviations from the nominal dimensions.

In practice, the following operations need to be performed to fit an awning to a caravan or the like. When the caravan or the like has been placed at the desired spot, the awning is taken from the baggage room or other storage room and taken from a bag or cover. Then, the awning cloth is unfolded and the appropriate edges of the side wall(s) and the roof of the awning are fixed to the caravan or the like. This is usually done with the aid of a beading to be slid into a profile, as already described hereinabove. Sliding the beading into the profile becomes more difficult according as the beading is slid further into the profile, because the sliding resistance will increase and also because an increasingly larger part of the tent-cloth will be suspended on the profile and must also be pulled along.

When the cloth is completely fixed to the caravan or the like, the tent frame needs to be placed under the tent cloth then hanging down. For this purpose, the frame from tent poles or tubes or the like needs to be built up under the cloth, or to be (partly) pre-assembled and then placed under the cloth. These operations can hardly, if at all, be carried out by one person. When the cloth lies on the frame in the right manner, finally, the awning can be tensioned using ground pins or tent pegs and optionally guy ropes.

SUMMARY OF THE INVENTION

The invention contemplates providing an awning construction which allows an awning to be brought into the operative position in a very simple manner and which makes the operations described hereinabove substantially redundant.

For this purpose, according to the invention, an awning construction for a camping accommodation or the like is characterized by a container mountable on a wall of a camping accommodation, arranged to include in a closed position of rest at least the tent cloth of an awning, while the container in mounted condition comprises a substantially horizontal and at least one substantially vertical section, which container further has an open position to take the awning out of the container and put it up, while the container is further provided with fixing means for an edge, located in the container, of the tent cloth of the awning.

BRIEF DESCRIPTION OF THE DRAWINGS

In the following, the invention will be described in more detail with reference to the appended drawing of a few exemplary embodiments, in which FIG. 1 diagrammatically shows an example of a mobile camping accommodation provided with an awning construction according to the invention in the position of rest, in which the awning construction is shown in end view.

DETAILED DESCRIPTION OF THE PREFERRED EMBODIMENTS

Figure 1:
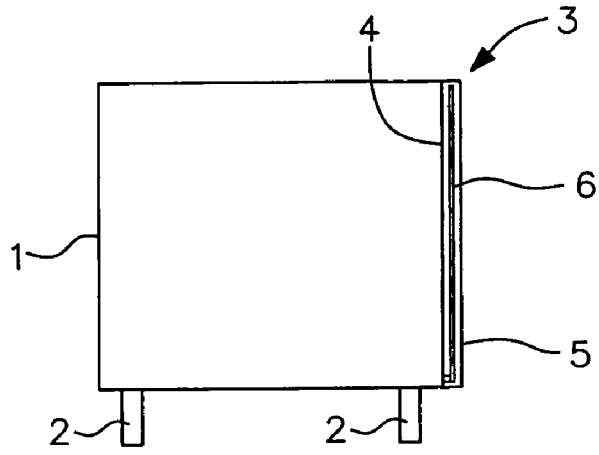

FIG. 1 diagrammatically shows an end view of a mobile camping accommodation 1, for instance a caravan, camper or the like, provided with wheels 2 and with an awning construction 3 according to the invention. The awning construction is shown in the position of rest and is arranged on a side wall 4 of the camping accommodation. For the sake of completeness, it is noted that the invention can be used with both a mobile and a non-mobile camping accommodation. In the case of a mobile camping accommodation, generally, the awning is in the position of rest both in prolonged absence of the users and when moving the camping accommodation. Therefore, the position of rest is also referred to as transport position. Further, the awning construction can naturally be arranged on a front or back wall as well. In this example, an awning construction according to the invention comprises a preferably closable and raintight container or casing 5, in which an awning can be included in folded condition. Preferably, the tent can be included in the container together with at least a part of a tent frame 6. The casing is fixedly attached to the wall 4 in a suitable manner, but preferably in such a manner that the casing can be detached for repair or the like. For this purpose, the so-called caravan rail can be used with advantage. The tent frame can be hingedly fixed in the casing and the tent cloth preferably remains fixed to the frame in the transport position as well. The tent cloth is not separately shown in FIG. 1.

Figure 2:
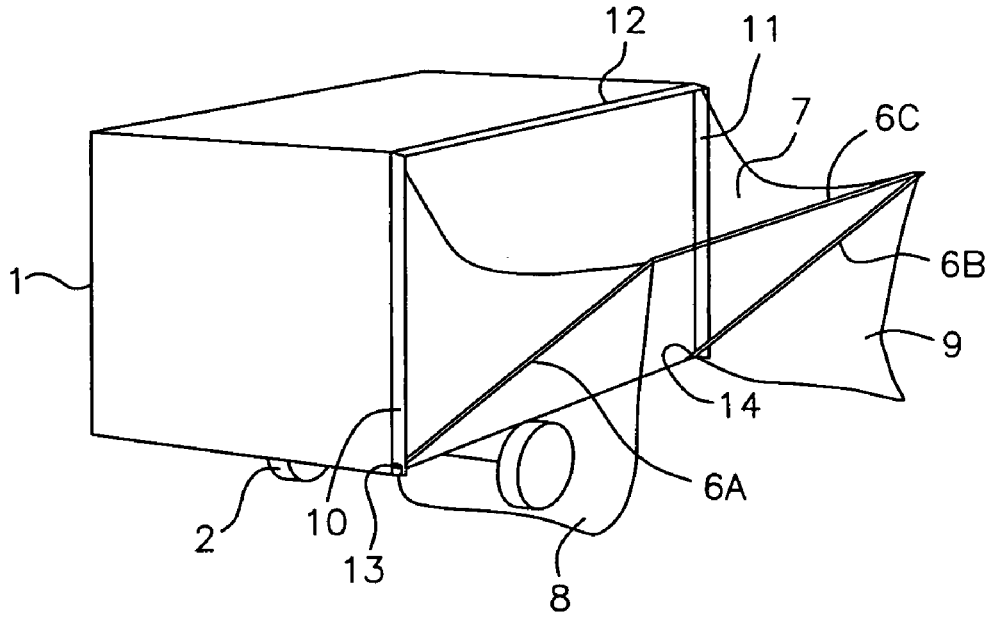
FIGS. 2 and 3 diagrammatically illustrate in perspective view, by way of example, in which manner an awning construction according to the invention can be brought from the position of rest into the operative condition.

FIG. 2 shows, in perspective view, the camping accommodation of FIG. 1 with the awning in partly unfolded condition. In this example, the awning comprises a porch-shaped tent frame 6 with two support tubes 6*a*, 6*b* inclined in the operative condition, and a horizontal top beam 6*c*, as well as a tent roof 7 and two side walls 8, 9 of suitable tent cloth.

Figure 9:
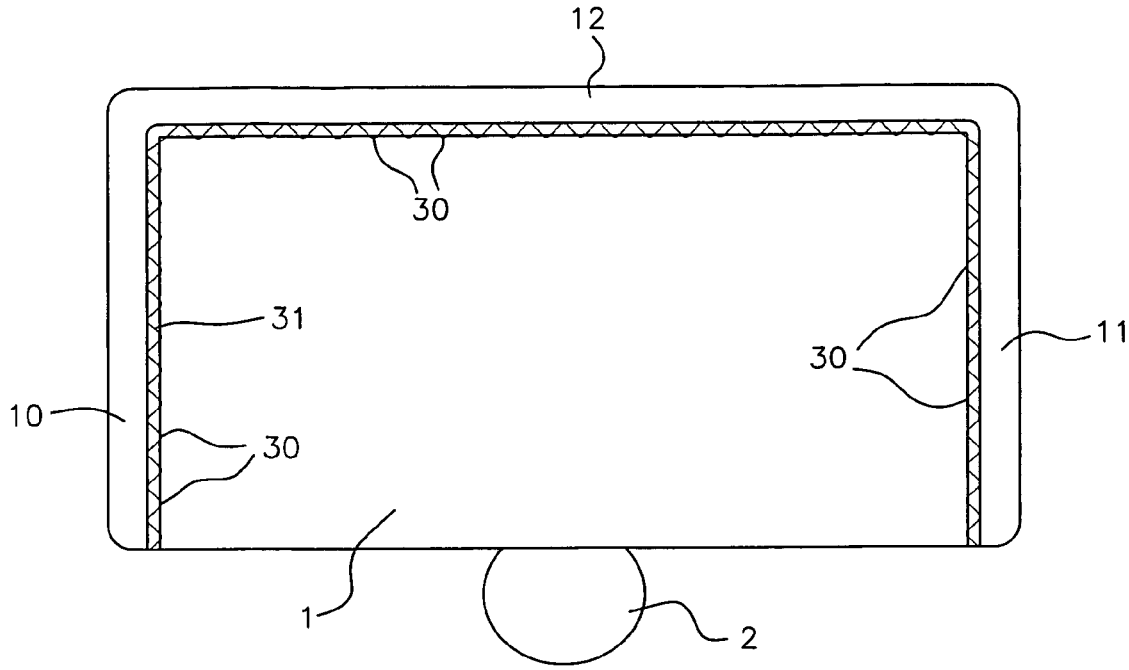
FIG. 9 diagrammatically shows a front view of an example of an awning construction according to the invention in the position of rest.

The casing 5 has a shape adapted to the tent frame and is thus inversely U-shaped in this example, with two substantially vertical sections 10, 11 and an upper horizontal section 12, as is, for instance, clearly shown in FIG. 9 as well.

The awning can further be provided with, for instance, an optionally detachable front wall and/or a canopy with associated tent poles. If desired, the casing can be designed such that a front wall and/or a canopy, with or without the associated tent poles, can also be put away in the casing. In the example of FIG. 2, the support tubes 6*a*, 6*b* are hingedly connected to the casing 5 at their lower ends at hinge points 13, 14. For this purpose, the casing is provided on the inside with fixed hinge parts, not shown in detail, which, for strengthening, may also be fixed through a back wall, if present, of the casing to the wall 4. It is also conceivable that the hinge parts are located under the lower ends of the casing and are directly fixed on the wall 4.

Figure 3:
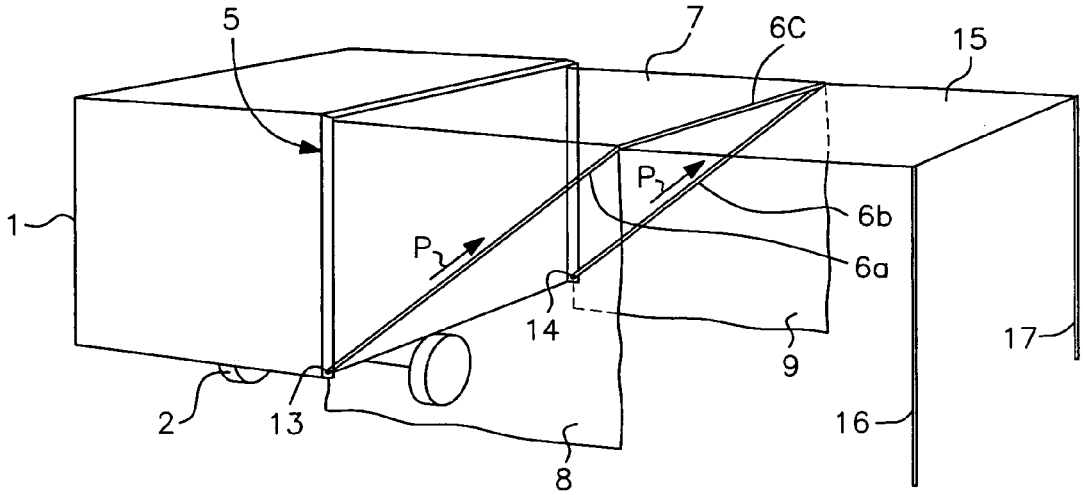

To be able to tension the roof 7 of the awning and to bring the side walls 8, 9 into the desired operative position, the support tubes are of telescopic design, so that they can be telescoped out, as indicated by arrows P in FIG. 3.

Figure 4:
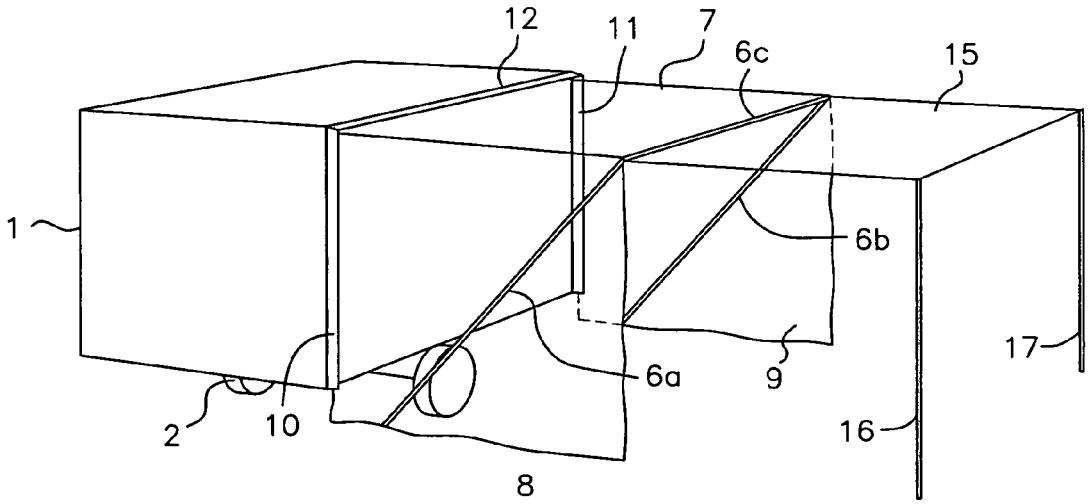
FIG. 4 diagrammatically shows an example of a variant of FIG. 2 and FIG. 3.

FIG. 4 diagrammatically shows a variant in which, in the operative condition, the support tubes 6*a*, 6*b* do not rest against the wall 4 but on the ground. For this purpose, the lower ends of the support tubes can be taken out of the casing. Here, if desired, hinges as described hereinabove can also be used, provided that the support tubes can be detached from the hinges in a simple manner. In the embodiment of FIG. 4, the support tubes 6*a*, 6*b* are also of telescopic design.

Both in FIG. 3 and in FIG. 4, a canopy 15 with tent poles 16, 17 is shown. The canopy can, in a known manner, be a front wall which can be turned up, which can be detachable or not, or a separate canopy, which can also be detachable or not. The tent poles 16, 17 can be telescopic tent poles, or tent poles assembled from shorter parts. Preferably, the casing is designed in such a manner that the canopy can also be put away in it. According to a further preference, tent poles 16, 17 can also be put away in the casing.

Figure 5:
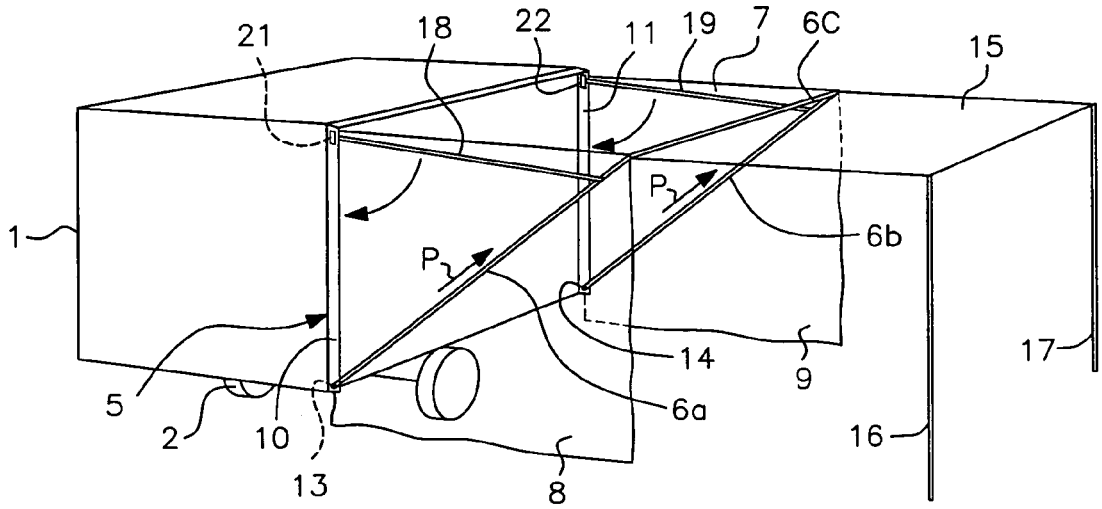
FIG. 5 diagrammatically shows an example of a second variant.
Figure 6:
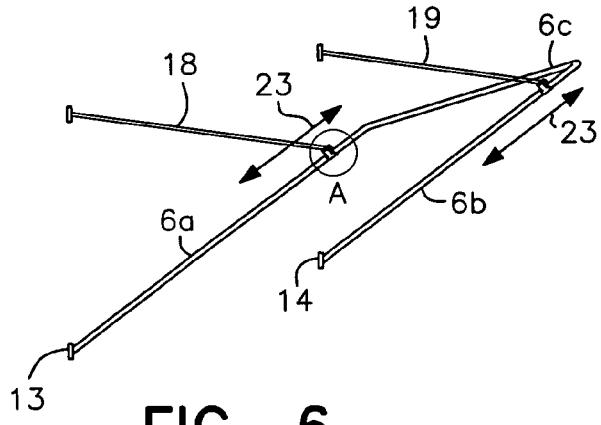
FIG. 6 diagrammatically shows, together with FIG. 6A, an example of a detail of FIG. 5.
Figure 6A:
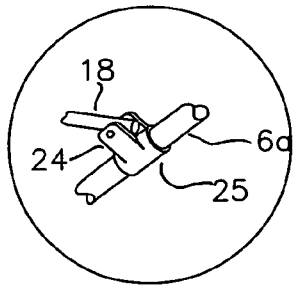

In a manner similar to the FIGS. 3 and 4, the FIGS. 5 and 6 diagrammatically show an exemplary embodiment of an awning construction according to the invention, in which additional tension poles 18, 19 are used. In this example, the tension poles 18, 19 are hingedly connected near the upper ends of the vertical sections 10, 11 of the casing 5 at hinge points 21, 22, using suitable hinge elements. The other ends of the tension poles 18, 19 are fixed to the upper parts of the support tubes 6*a*, 6*b* such that the ends of the tension poles can slide along the support tubes, as indicated by arrows 23. FIG. 6A shows an example of a possible sliding construction. In this example, a tension pole 18 is hingedly connected to an ear or between two ears 24 of a slide bush 25, which encases a support tube 6*a* and can slide along the support tube. Preferably, a detent is used, such as, for instance, a spring knob known per se which is located in the support tube and extends through an opening in the wall of the support tube outwards, to stop the slide bush on the support tube in the optimum position of the tension pole. Similar detents can also be used for the telescopic parts of the support tubes. By having the tension poles hinge downwards from the position drawn, the cloth of the awning can be tensioned. In this example, the tension poles are easily detachable at least either at the hinge points 21, 22 or at the slide bushes, so that, in a storage position, the tension poles can be turned along the support tubes or in a casing section.

It is also possible to design the hinge points to be vertically slidable along the wall.

When the awning roof 7 is tensioned in the manner described, the side walls 8, 9 can be fixed using ground pins. As an alternative, a U-shaped support bracket can be used, which can be folded down from a position of rest against the wall of the camping accommodation. Then, the front side of the bracket rests, for instance, on the ground, and the legs support and tension the side walls. The cross connection of the U-shaped bracket can optionally be located on the wall of the camping accommodation and can optionally be interrupted. If desired, the front wall can then be put up as a canopy and be supported by tent poles 16, 17 or also by a support bracket.

Figure 7:
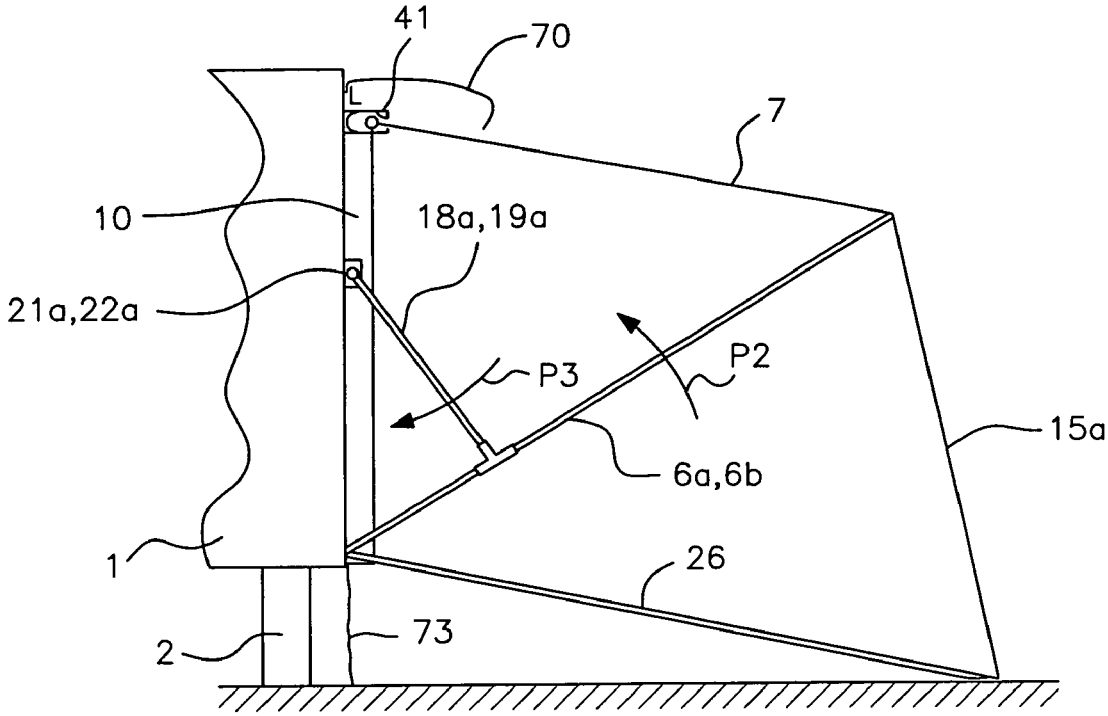
FIG. 7 diagrammatically shows an example of a third variant.

FIG. 7 diagrammatically shows an example of an awning construction according to the invention, in which tension poles 18*a*, 19*a* are used which are similar to the tension poles 18, 19 of the example of FIG. 5 and FIG. 6. However, the tension poles 18*a* and 19*a* have a steeper operative position and can therefore, when the support tubes 6*a*, 6*b* pivot upwards according to the arrow P2, hinge downwards from the hinge points 21*a*, 22*a* according to the arrow P3 to an end position in which the tension poles lie along the support tubes against the wall of the camping accommodation. The tension poles do not need to be detachable then. If desired, the hinge points 21*a*, 22*a* can be vertically slidable along the wall of the camping accommodation (arrow P5), alone or in combination with slide bushes 25. In the example shown, the hinge points of the tension poles are arranged relatively on the wall of the camping accommodation. Further, in this example, a support bracket 26 is provided for the side walls Also. in FIG. 7, a part of a hinged lid 70 of the casing is shown.

The support bracket 26 can also advantageously serve to fix the lower edge of a front wall 15*a*. Then, a closable entrance opening can be provided in the front wall in a usual manner.

FIG. 7 further shows diagrammatically a sealing strip or ground skirt 73, which can optionally be fixed to the side walls. If desired, the ground skirt can be put away in a lower horizontal section 74 of the casing, as is diagrammatically shown in FIG. 16. The horizontal section is mounted near or optionally, below the lower edge of the wall 4 of the camping accommodation.

If desired, it is possible to design the awning with a ground cloth, which can be put away in a casing in the position of rest in a manner similar to the manner already described.

Figure 8:
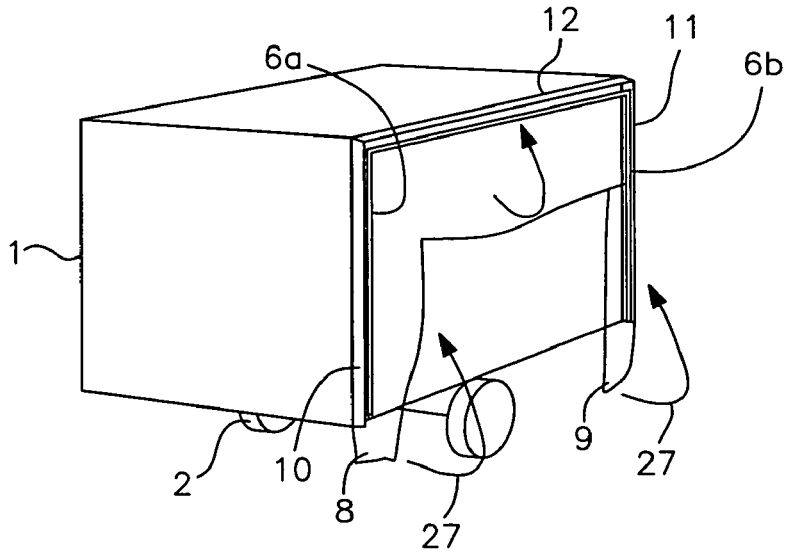
FIG. 8 diagrammatically illustrates, by way of example, how an awning construction according to the invention can be brought from the operative condition into the position of rest.

When using a fixed front wall, and possibly also when using a separate front wall to be fixed to the roof using a zipper, the front wall, when putting away the awning, can first be placed on the roof. Then, the tent frame is folded up in the casing. This situation is shown in FIG. 8. Then, any loose parts of the roof (with front wall) and the side walls are rolled up and/or folded up and brought into the casing as shown by arrows 27. Directly after, the casing is locally closed in a manner to be described hereinafter, so that the tent cloth cannot fall out of the casing.

Figure 16:
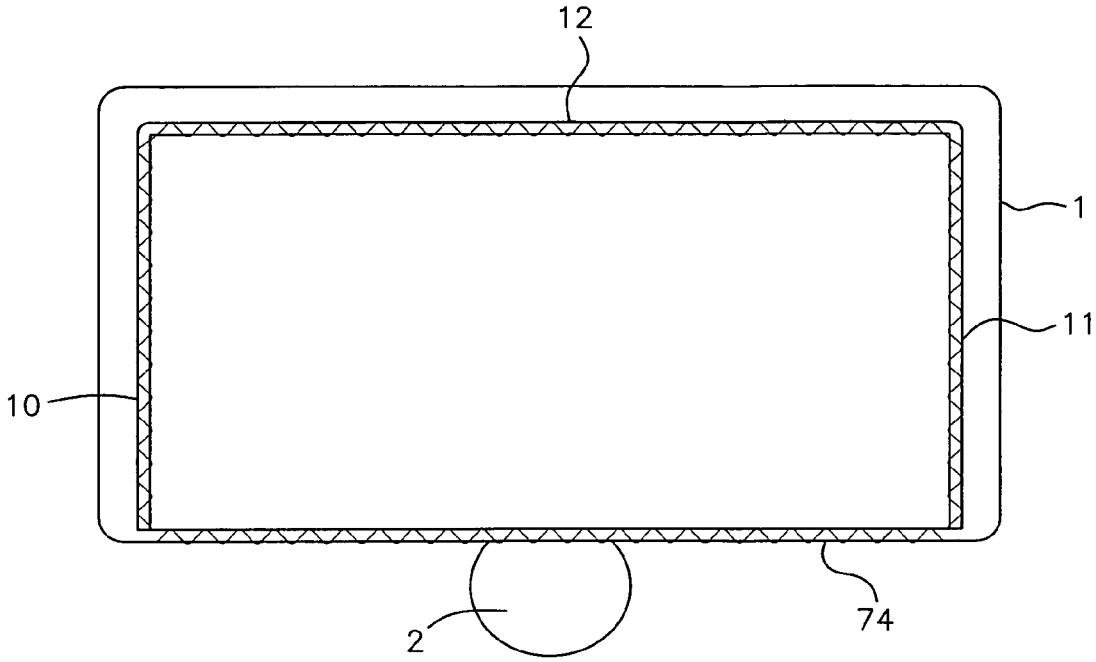
FIG. 16 diagrammatically shows a variant of FIG. 9.

Finally, the casing is closed completely, resulting in the condition shown in FIG. 9 and FIG. 16. The awning construction is then in the transport position. In the example of FIG. 9, the casing is closed using an elastic cord 31 hitched to hooks 30.

Figure 10:
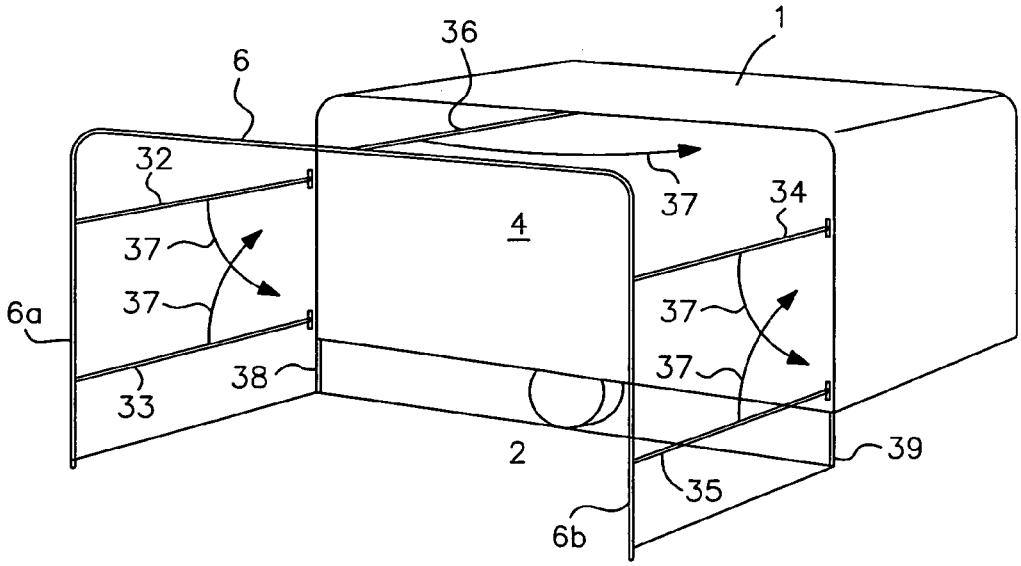
FIG. 10 and FIG. 11 diagrammatically show examples of two additional variants of an awning construction according to the invention.

FIG. 10 diagrammatically shows an exemplary embodiment, in which a porch-shaped tent frame 6 is used, which, in the operative condition, is completely separate from the vehicle at a distance from the wall 4 thereof. In this example, between the vehicle and the porch-shaped frame 6, a number of tension tubes substantially horizontal in operation are used, which, in this example, are hingedly fixed in the casing and detachably fixed to the porch-shaped tent frame. In the example shown, per vertical casing section and porch section respectively, two tension tubes 32, 33 and 34, 35 respectively are used, as well as one tension tube 36 for the horizontal section. The tension tubes can be pivoted into the casing to be brought into the transport position, as indicated by arrows 37. FIG. 10 further shows tent tubes 38, 39 which can be slid out downwards at the vertical casing sections, to which the side walls and optionally a sealing strip, also called ground skirt, can be fixed to the under side of the vehicle. The vertical sections 6*a* and 6*b* of the porch-shaped frame can have similar telescopic lower ends which can be slid out downwards.

Figure 11:
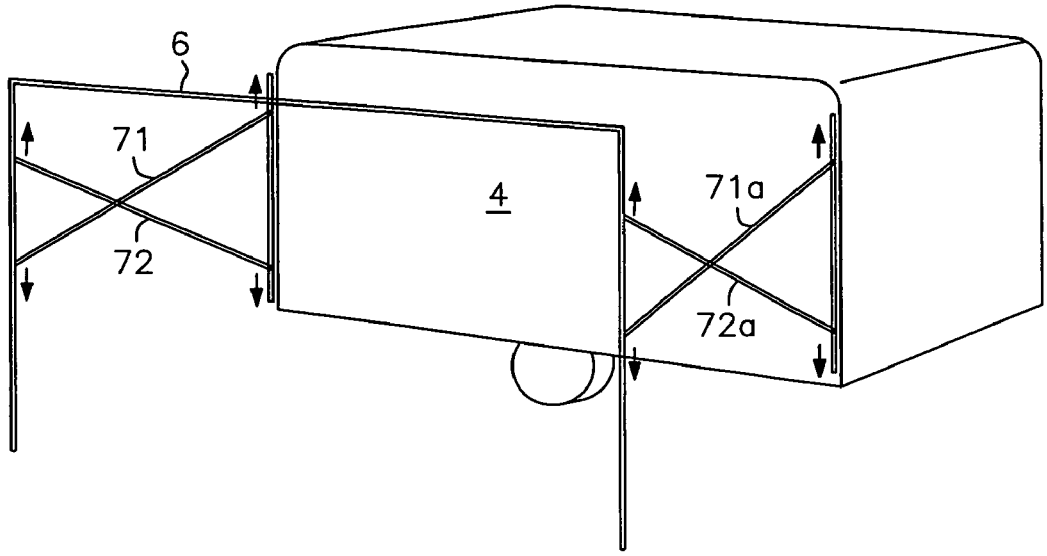

In FIG. 11, between the legs of the porch-shaped tent frame 6 and the wall 4 of the camping accommodation, tension tubes 71, 72 and 71*a*, 72*b* respectively are crosswise provided, the ends of which can slide along the wall 4 and/or the legs of the porch frame as indicated by arrows. The crosswise-arranged tubes can be designed as a linkage mechanism.

Figure 12:
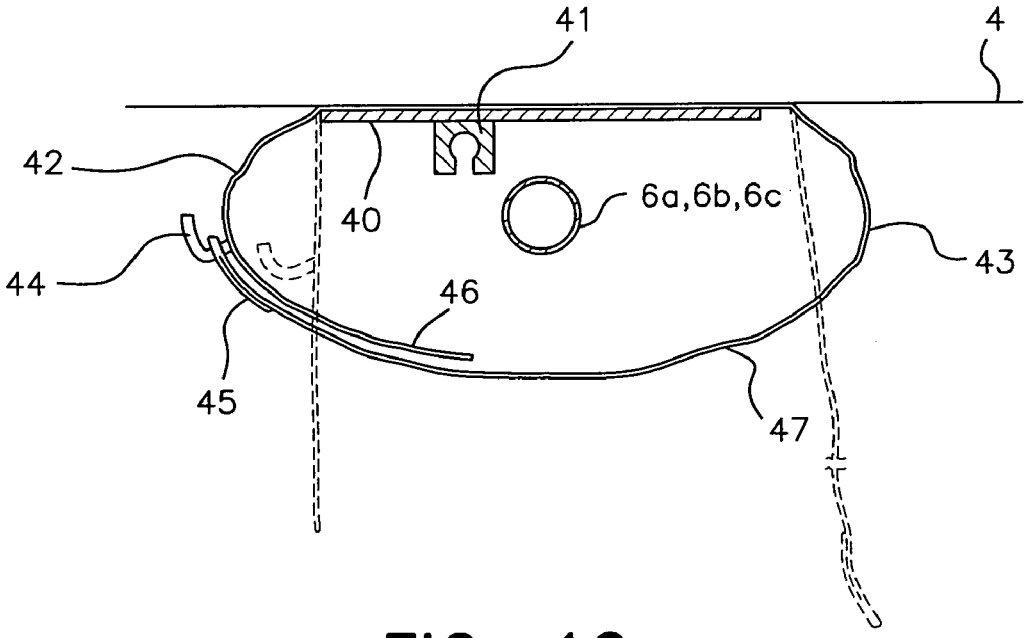
FIGS. 12, 13 and 14 diagrammatically show, in cross-section, a few examples of a casing for an awning construction according to the invention.
Figure 13:
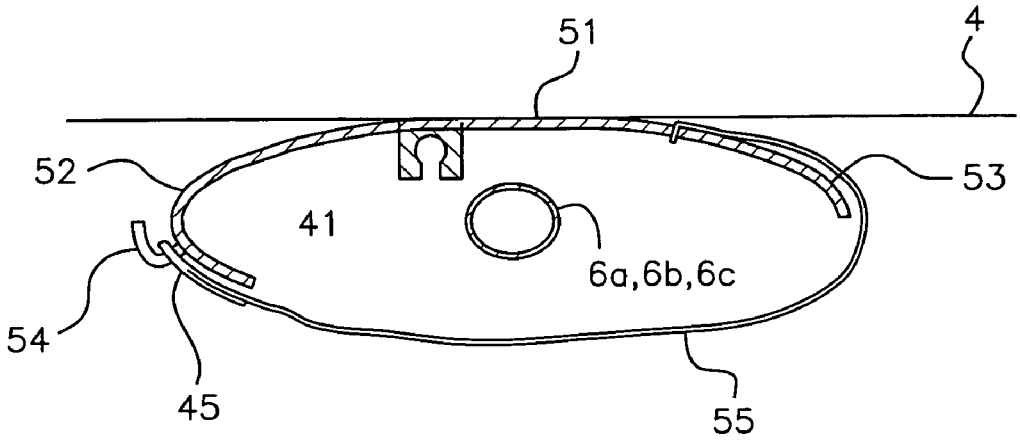
Figure 14:
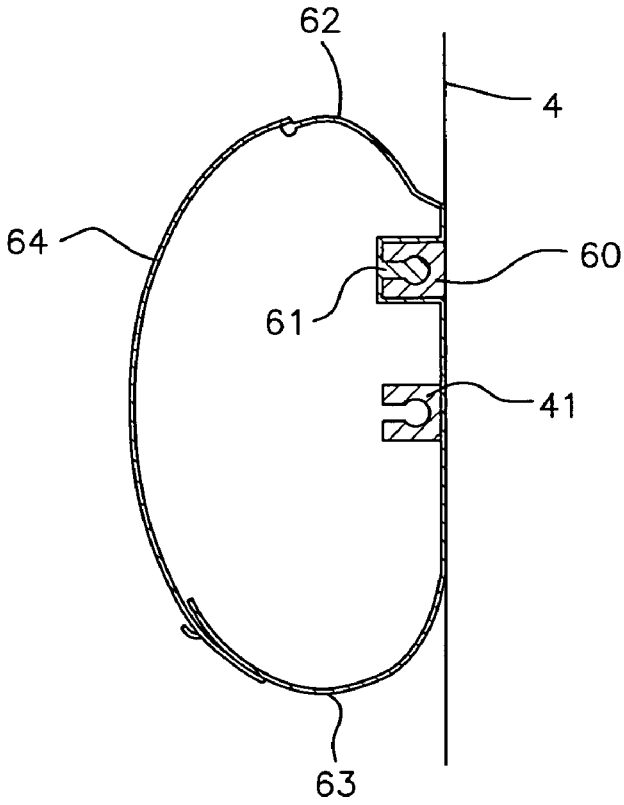

The FIGS. 12, 13 and 14 diagrammatically show, in cross-section, a few exemplary embodiments of a casing for an awning construction according to the invention. In the example of FIG. 12, a baseplate 40 is fixed on the wall 4 of the camping accommodation. The tent cloth (not shown) is fixed to the baseplate in a suitable manner, for instance using a beading profile (caravan rail) 41. Between the vehicle wall 4 and the baseplate, a strong waterproof fabric 47, for instance plasticized polyester cloth, is clamped, which has a free strip 42, 43 laterally extending beyond the baseplate on both sides. The one strip 42 is provided with hooks 44 and the other strip 43 is provided with an elastic tension cord 45 or tension rubber or the like. The strip 43 can be fixed over the strip 42 to the hooks of the strip 42 using the tension cord or the like. The strip 42 extends beyond the hooks 44 with a flap 46, which results in a well-closed casing. In FIG. 12, the casing is shown in the closed position. The tent frame and the tent cloth are within the casing. In FIG. 12, a tent frame tube 6*a*, 6*b*, 6*c* is shown in cross-section.

In the example of FIG. 13, a baseplate 50 is used, which has, from a fixing section 51, where the baseplate is fixed to the wall 4 of the camping accommodation, sections 52, 53 slightly bent forwards on both sides. In this example, the two sections 52, 53 have the shape of a part of an ellipse. In this example, the section 52 is bent forwards further than the other section and has hook-shaped elements 54. Further, between the baseplate and the vehicle wall, a strong waterproof cloth 55 is again fixed which extends along and beyond the section 53 and which is provided with a tension cord or tension rubbers 45 or the like for attachment to the hook-shaped elements 54.

FIG. 14 shows another example of a casing for an awning construction according to the invention. The casing shown is manufactured from a hard material, for instance plastic, and fixed against the wall 4 of a camping accommodation using a support profile 60. In this example, the support profile cooperates in a form-closed manner with a profiling 61 provided in the back wall of the casing to provide a form-closed connection, for instance a snap connection. The caravan rail usually already present can advantageously be used as a support profile. The casing has sections 62, 63 bent forwards on both sides of the fixing point on the wall 4. To the section 62, a hinged lid 64 is fixed, which can be attached with an overlap on the section 63 using tension rubbers, a tension cord or other suitable closing mechanisms to form a closed box.

Figure 15:
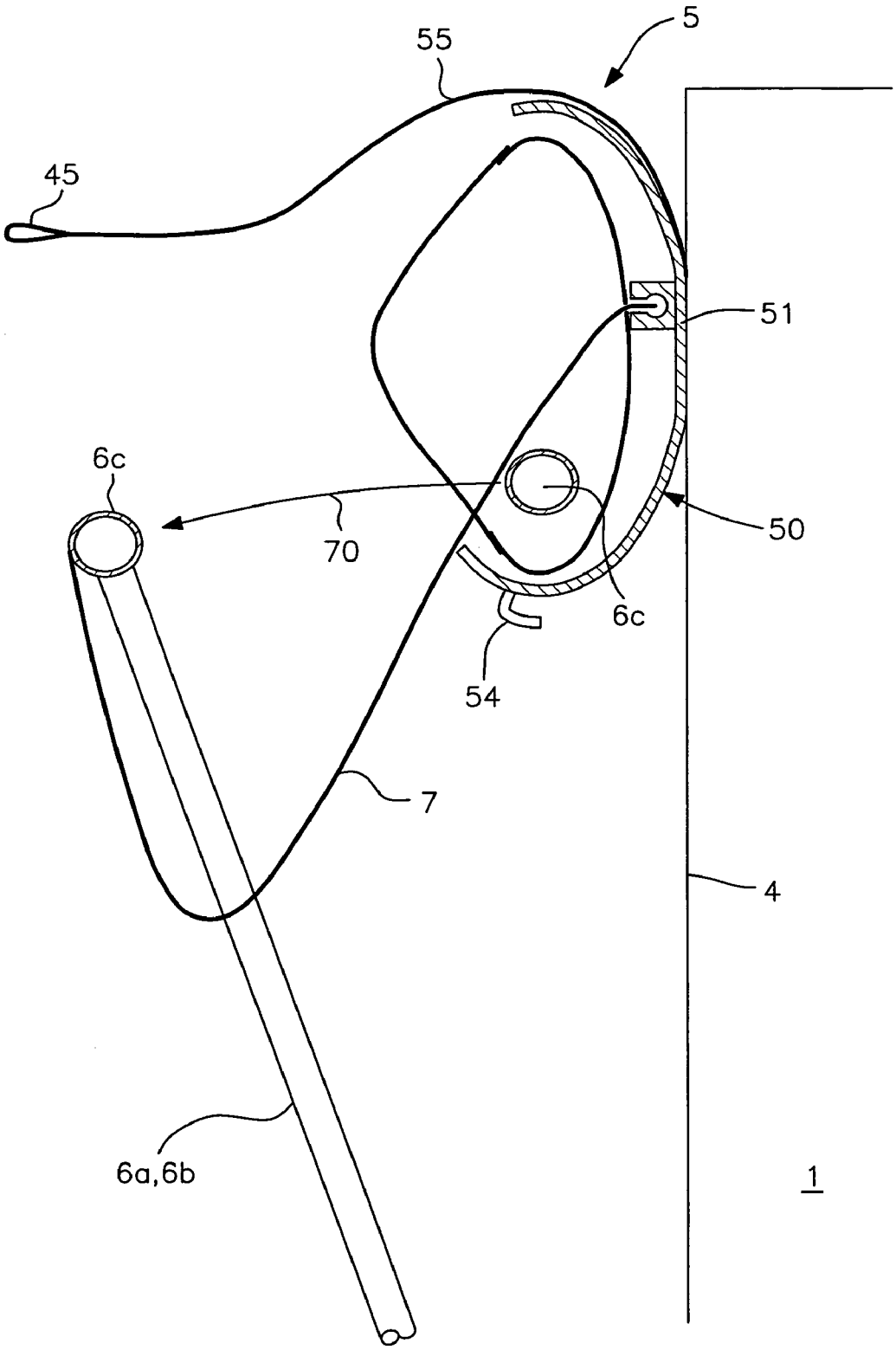
FIG. 15 again diagrammatically shows how a tent frame with tent cloth is put away in a casing or taken out of a casing.

For the sake of completeness, FIG. 15 diagrammatically shows how an awning can be taken from a casing fixed on a wall of a camping accommodation or can be put away in a casing.

In the situation shown in FIG. 15, a porch-shaped tent frame 6*a*, 6*b*, 6*c* has been pivoted outwards from the casing 5 through a particular angle as indicated by arrow 70. In this example, the casing is of the type shown in FIG. 13, but any other type, whether or not shown in the other Figures, in which the awning and the tent frame can be put away, can be used.

The tent frame is between the transport position and the operative position and the tent roof 7 is still slack. If a front wall and/or canopy is present, this can lie on the roof 7. The casing has been opened by detaching the tension cord, the tension rubber or the like, indicated by 45, from the hooks 54 and folding the casing cloth 55 upwards. Upon further pivoting of the tent frame, the tent roof 7 is tensioned and the front wall and/or canopy, if present, can be pulled forwards, from the roof. The awning can then be put up further, as already described hereinabove.

When the tent frame is pivoted against the direction of the arrow 70, the frame will again be in the casing. The tent roof 7 and also, of course, the side walls are still hanging outside the casing and can be rolled up and/or folded up and put away in the casing. Optionally, loose tent poles, for instance canopy poles, can also be put away in the casing, which can then be closed (further).

The awning construction is then in the transport position and the camping accommodation can be moved. The awning construction described including a number of walls and preferably also the frame can always remain fixed to the camping accommodation and is in effect at one with the camping accommodation and can be considered an integrated awning.

It is noted that, after the foregoing, various modifications will readily occur to those skilled in the art. In particular, many variant embodiments of the casing and the tent frame are possible.

As shown in the Figures, the casing can have a lid in the form of one or more sealing flaps or a lid of hard material, but it can also have a more open construction, in which the awning cloth and, depending on the embodiment, the frame is (are) only held by tension rubbers, tension cords, straps or the like. In that case, the awning is exposed to weather influences in the position of rest, but this-is also the case in the camping position.

If the container or the casing is arranged to include only the tent cloth, but not the frame, the frame can be built up from loose parts and be placed in the usual manner. The frame is then taken along separately.

It is noted that various details of the different embodiments can be combined, depending on the design desired by the user.

Furthermore, the container or the casing can comprise a number of flexible tensioners or a number of flaps which are fitted on the roof and the side walls, or one of the side walls. When using flaps, more elastic tensioners can be used, which can be attached to hooks or the like on the camping means to keep the flaps in the closing position.

Figure 17A:
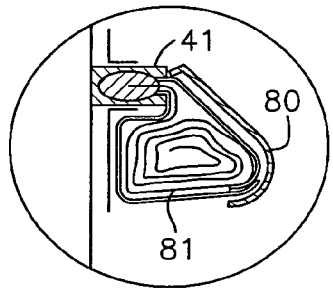
FIG. 17 diagrammatically shows, together with FIG. 17A, an additional example of a casing for an awning construction according to the invention.
Figure 17:
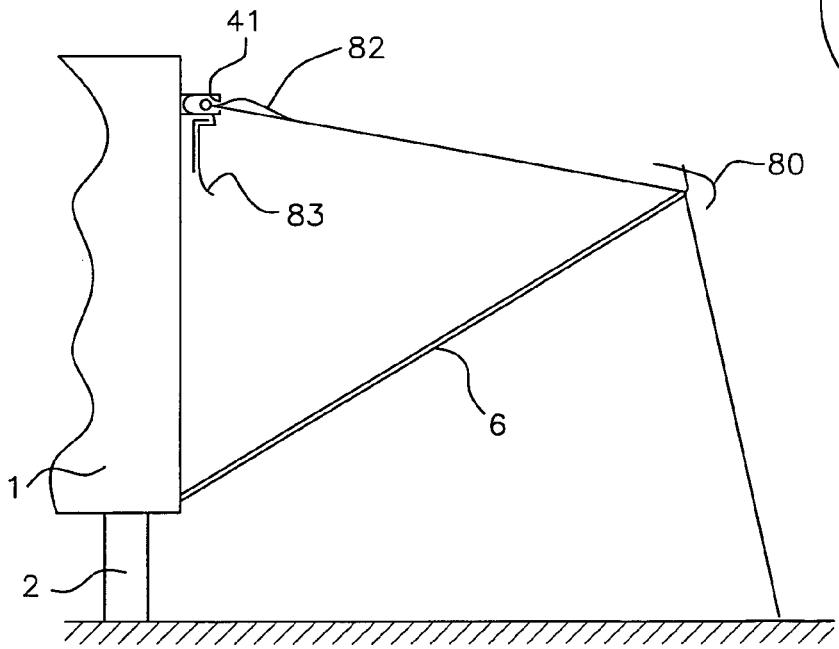

In the case of an integrated frame, the container can also be partly formed by a slightly flexible shell-shaped element provided on a cross tube or the like, which is located on the front and upper edges of the awning, as is diagrammatically shown in FIG. 17 at 80. FIG. 17A shows the awning at 81 in stored condition. In this example, the container comprises flasp 82, 83 or the like and the shell-shaped element 80. The flaps or the like are fixed to or near the caravan rail 41. The flaps can be flexible but can also be made of hard material. It is also possible for one of the flaps, for instance the upper flap, to be manufactured from hard material which can be flexible or not, for instance plastic or aluminum and to be hingedly fixed, thereby yielding a lid construction. The same holds true if no shell-shaped element is used on the frame tube.

To facilitate the rolling up of the tent cloth, preferably roll-up aids are used. It is, for instance, possible, at the front of the roof and the walls, to fix a flexible hose, tube, rod or the like, preferably having a circular cross section, in or to the tent cloth. Then the flexible hose, tube, rod or the like has an inverted U-shape in the camping position of the awning. By grasping and turning the hose or the like with two hands, the tent cloth is rolled up into the container. In that case, the frame must be folded up or disassembled beforehand.

An awning construction according to the invention can also be provided with fold-up or roll-up means which can be hand-operated or motor-driven. Examples of these could be ropes and pulleys, as used for window awnings, optionally in combination with a number of stays in or on the side walls and optionally the roof.

Another possibility is the use of a drivable roll mounted in the container. The roll can be flexible as a whole, but can also be of flexible design only at the transition between the horizontal and vertical sections of the container. In that case, flexible connecting pieces can be used. The roll is, at at least one end, hand-drivable (for instance using a crank) and/or drivable by a driving motor, for instance an electromotor. An alternative may be to use a coil spring provided in a roll, which is tensioned as the awning is put up and which automatically rolls up the cloth when putting away the awning. Preferably, a locking mechanism is present to absorb the tension force of the spring and to relieve the awning when the awning has been put up.

Figure 18:
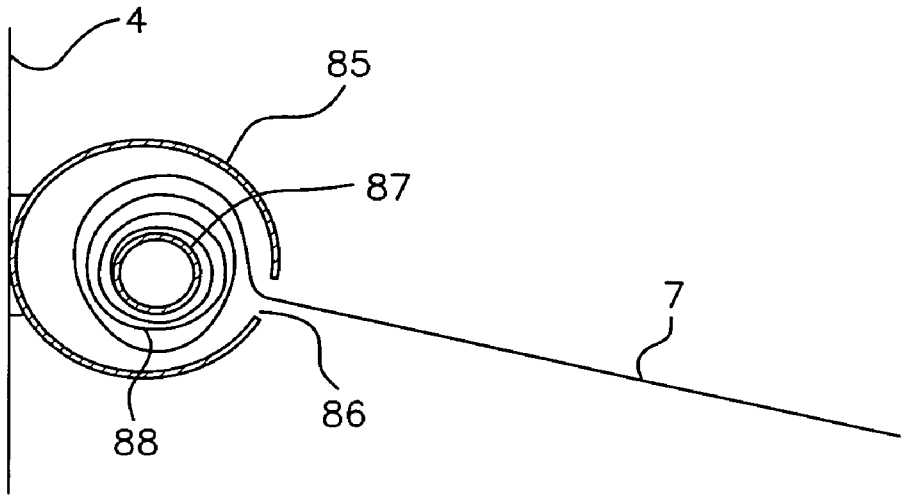
FIGS. 18 and 19 diagrammatically show examples of roll-up devices.

An exemplary embodiment of a roll-up mechanism is diagrammatically shown in vertical cross-section in FIG. 18. In this example, the roll-up mechanism comprises a substantially round tubular housing 85, which is fixed to the wall of the camping accommodation and which is provided with a passage slot 86 for the tent cloth 7. In the housing 85, a roll 87 drivable manually and/or using a motor or using a spring or in another manner is located, on which the tent cloth can be rolled. In the situation shown, the tent cloth is partly rolled up, as indicated at 88.

Figure 19:
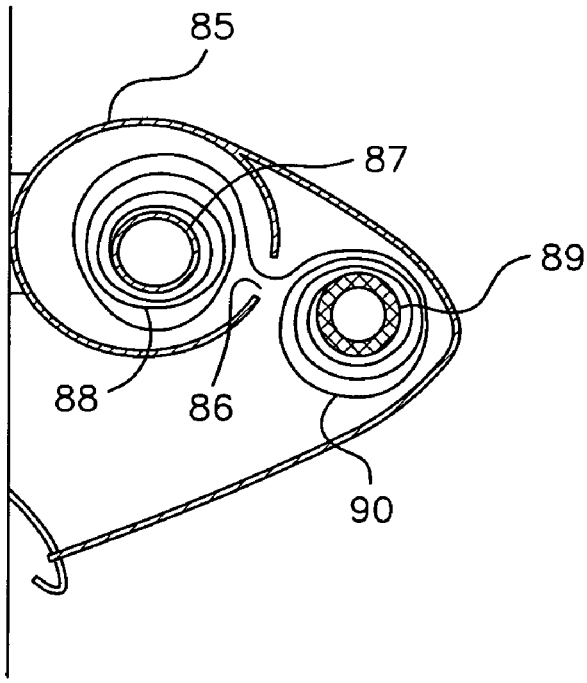

It is also possible for a drivable roll-up mechanism as shown in FIG. 18 to be combined with a flexible roll-up hose or the like, which is fixed at the front in or to the tent cloth, as already described hereinabove. The tent cloth is then partly rolled up in the housing 85 and partly rolled up manually. This situation is diagrammatically shown in FIG. 19. The flexible hose or the like is shown at 89. The casing is shown in closed condition. The tent cloth is partly in the housing 85 and partly outside it and the casing encloses the cloth roll 90 located outside the housing.

Figure 20:
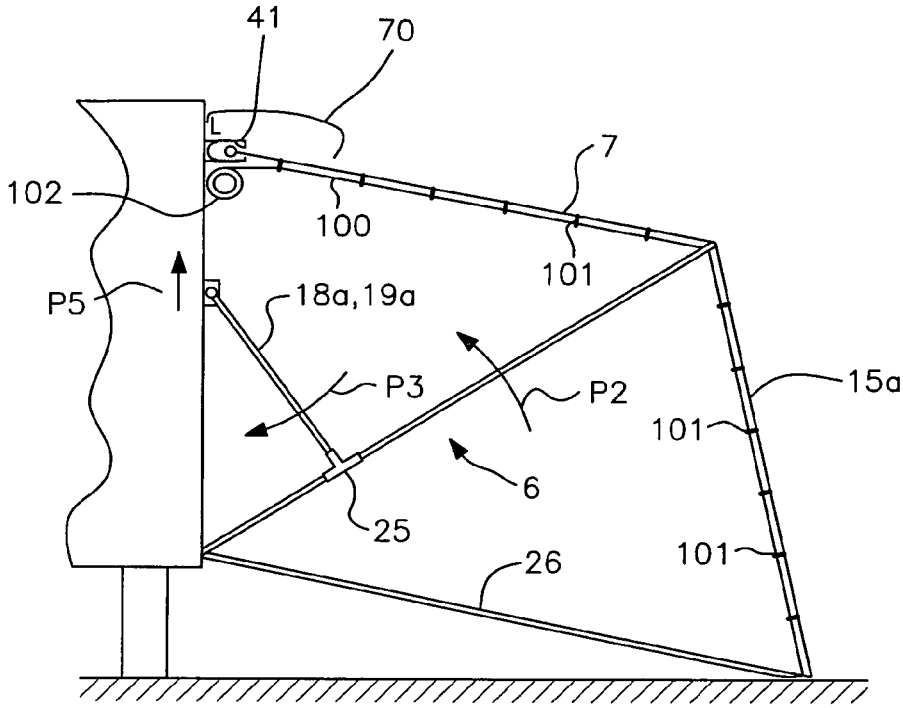
FIG. 20 diagrammatically shows an example of an awning construction according-to the invention which can be (semi-)automatically folded up or put up respectively.

FIG. 20 diagrammatically shows in vertical cross-section an example of an awning construction which can be put up and folded up using driving means. The construction shown is similar to that in FIG. 7 and comprises a porch-shaped tent frame 6 with inclined telescopic tubes, as well as a lower support bracket 26 and tension tubes 18*a*, 19*a*.

Along the inside of the roof 7 and the front wall 15*a*, one or more pull cords 100 are provided, which are fixed to the lower roll of the front wall, for instance to the support bracket 26, and extend through loops 101 or the like provided at regular distances. The pull cords are further fixed to a drivable roll 102, which, in this example, is mounted just below the caravan rail 41. The roll 102 can, for instance, be fixed on the caravan wall or on the caravan rail, optionally using brackets or the like. The roll can be drivable manually or using a motor or using a spring or the like. An electromotor can advantageously be used to drive the roll. If desired, at suitable positions in the side walls and optionally the roof, stays can be provided to make the construction more rigid.

If the driving motor of the roll 102 is excited from the camping position shown, the pull cords will be rolled up on the roll 102. The lower edge of the front wall will thereby be pulled upwards. The support bracket 26 and the porch 26 will be pulled along and hinge upwards. The tension poles will slide along, if their angle of inclination is chosen correctly, and the support tubes of the porch frame will slide together, preferably against the pressure of one or more tension springs. Such tension springs can, for instance, be provided in the support tubes. The tent cloth is thus pulled against the wall 4 and into the container. As a result, the tent cloth will fold up in the manner of a window awning. Then, the lid 70 of the container is closed and fixed in a suitable manner.

The putting up of the awning is done in a reverse manner. First, the lid 70 is detached and then the roll 102 is driven. By means of, for instance, tension force provided by spring means or by, for instance, pulling the support bracket 26, the awning is put up (semi-)automatically.

It is noted that, after the foregoing, various variants will readily occur to a skilled person. For instance, the casing and the tent frame can have a sloping section adapted to the sloping front wall of some caravans. Also, various details of the different embodiments can be combined. The container or the casing can be designed in many variations, just like the driving means.

Such and similar variants and modifications are considered to fall within the scope of the invention.

The invention claimed is:

1. An awning construction for a camping accommodation, the awning construction comprising a container mountable on a wall of the camping accommodation, the container including, in a closed position of rest, at least tent cloth of an awning, the awning having a substantially horizontal part and at least one substantially vertical part, said at least one substantially vertical part being connected to said horizontal part, the container having a substantially horizontal section and at least one substantially vertical section, said at least substantially vertical section being connected to one end of said horizontal section, said horizontal section receiving said horizontal part and said at least one vertical section receiving said at least one vertical part, means for holding an edge of the tent cloth of the awning being provided in both said horizontal section and said at least one vertical section, and the container having an open position for taking the awning out of the container and erecting the awning.

2. The awning construction according to claim 1, wherein the container is arranged to include at least a part of a frame of the awning.

3. The awning construction according to claim 1, wherein the awning includes an inverted U-shaped tent frame and that the container has a corresponding shape with a horizontal section and two vertical sections at the ends thereof.

4. The awning construction according to claim 3, wherein legs of the tent frame are fixed at downwardly turned free ends via hinges to the camping accommodation.

5. The awning construction according to claim 3, wherein legs of the tent frame are detachable at downwardly turned free ends.

6. The awning construction according to claim 1, wherein a frame of the awning includes a number of telescopic support tubes.

7. An awning construction according to claim 1, characterized in that the frame of the awning comprises a number of pivotable and/or slidable tension poles which, in operation, extend between the container and other frame parts and which cooperate with those other frame parts to tension the tent cloth.

8. An awning construction according to claim 3, characterized in that the awning comprises a support bracket for at least the side walls.

9. An awning construction according to claim 1, characterized in that the container, near the lower ends of the vertical section(s), contains a tent tube which can be put out downwards.

10. An awning construction according to claim 6, characterized in that at least a number of tension poles are fixed at the ends remote from the container to a slide bush which is provided around a support tube of the tent frame and is slidable along that support tube to bring the support tube in such a position that the tent cloth is tensioned.

11. The awning construction according to claim 1, wherein fixing means for the tent cloth includes a caravan profile provided in the container and cooperates with a beading along an edge of the tent cloth.

12. The awning construction according to claim 1, wherein the container has a baseplate fixable to a wall of a camping accommodation with edges bent forwards and partly towards each other, as well as a lid of hard waterproof material hingedly wed to one of the edges, which is fixed to another edge using closing means to form a closed box.

13. The awning construction according to claim 1, wherein the container substantially consists of detachable holding means in a shape of hooks fixed to the wall of the camping accommodation and one of tension cords and tension rubbers cooperating therewith.

14. An awning construction according to claim 1, characterized in that the container comprises a number of flaps of flexible or semi-flexible material provided along the side wall(s) and the roof of the camping accommodation as well as securing means for those flaps.

15. An awning construction according to claim 1, characterized in that the container is arranged to be fixed on a caravan rail.

16. An awning construction according to claim 1 characterized by roll-up aids.

17. An awning construction according to claim 16, characterized in that the roll-up aids comprise a flexible tube, hose, rod or the like provided along the front edges of the roof and the side wall(s).

18. An awning construction according to claim 1, characterized in that operating means are provided for putting up and putting away the awning, which operating means comprise a drivable roll.

19. An awning construction according to claim 18, characterized in that the drivable roll is connected to a front edge of the awning via pull cords or the like.

20. An awning construction according to claim 19, characterized in that the front edge is formed by the lower edge of a front wall.

21. An awning construction according to claim 18, characterized by frame parts being under spring tension in the operative position, which can be brought into the position of rest against the spring tension.

22. An awning construction according to claim 18, characterized in that the drivable roll has an inverted U-shape, wherein the roll is flexible at least at the corners of the U-shape.

23. An awning construction according to claim 22, characterized in that the roll is at least partly provided in a tubular housing, which is provided with a passage slot for the tent cloth and which is fixed to the wall of the camping accommodation.

24. An awning construction according to claim 22 and further comprising roll-up aids including a flexible tube, hose, rod or the like provided along the front edges of the roof and the side wall(s).

25. An awning construction according to claim 18, characterized by driving means which are operable manually and/or using a motor or a spring which cooperate with the drivable roll.

26. An awning construction according to claim 1, characterized in that the container comprises a lower horizontal section for including a ground skirt.

27. An awning construction for a camping accommodation, the awning construction comprising a container mountable on a wall of the camping accommodation, the container including, in a closed position of rest, at least tent cloth of an awning, and the container including a substantially horizontal and at least one substantially vertical section, the container having an open position for taking the awning out of the container and erecting the awning and the container further including fixing means for an edge of the tent cloth of the awning, located in the container, the container including a baseplate fixable to a wall of the camping accommodation and a cover made of flexible weather-resistant material connected to the baseplate and having two free edges on both sides of the baseplate, one of the two free edges being provided with first closing means for cooperating with second closing means on the other of the two free edges.

28. The awning construction according to claim 27, the first and second closing means include one of tension rubbers and a tension cord and hook-shaped elements for cooperation therewith.

29. An awning construction for a camping accommodation, the awning construction comprising a container mountable on a wall of the camping accommodation, the container including, in a closed position of rest, at least tent cloth of an awning, and the container including a substantially horizontal and at least one substantially vertical section, the container having an open position for taking the awning out of the container and erecting the awning and the container further including fixing means for an edge of the tent cloth of the awning, located in the container, the container having a baseplate fixable to a wall of the camping accommodation with edges bent forwards from the wall, one of the edges being provided with second closing means and from the other of the edges, a strip of flexible waterproof material with a free edge extends, which is provided with first closing means for cooperating with a second closing means.

* * * * *